US005483854A

United States Patent [19]

King et al.

[11] Patent Number: 5,483,854

[45] Date of Patent: Jan. 16, 1996

[54] APPARATUS FOR REMOVING CORK AND STOPPERING STRUCTURE FROM PRESSURIZED BOTTLE

[75] Inventors: Timothy P. King, Stanfordville; Stacy Walsh, New York, both of N.Y.

[73] Assignee: K2 Development Corporation, Pine Plains, N.Y.

[21] Appl. No.: 398,714

[22] Filed: Mar. 6, 1995

[51] Int. Cl.[6] ..... B67B 7/44

[52] U.S. Cl. ..... 81/3.4; 81/3.09; D8/42

[58] Field of Search ..... 81/3.4, 3.44, 3.47, 81/3.48, 441, 121.2; D8/42

[56] References Cited

U.S. PATENT DOCUMENTS

| | | | |
|---|---|---|---|
| D. 319,957 | 9/1991 | Bergmeister | D8/42 |
| 948,392 | 2/1910 | Dougherty | 81/3.48 |
| 2,631,482 | 3/1953 | Rinehart | 81/3.4 |
| 3,812,741 | 5/1974 | Heine | D8/40 |
| 3,996,819 | 12/1976 | King | 81/124.6 |
| 4,442,735 | 11/1982 | Chance et al. | 81/3.44 |
| 4,653,355 | 3/1985 | Brewton et al. | 81/3.44 |
| 4,708,033 | 11/1987 | Eash | 81/3.37 |
| 4,726,264 | 2/1988 | Bost | 81/3.09 |
| 4,800,783 | 1/1989 | Allen | 81/3.4 |
| 4,911,038 | 3/1990 | Ferrin | 81/3.4 |
| 5,042,331 | 8/1991 | Allen | 81/3.4 |
| 5,372,054 | 12/1994 | Federighi, Sr. | 81/3.09 |
| 5,388,297 | 2/1995 | Ross | 81/3.09 |

FOREIGN PATENT DOCUMENTS

| | | |
|---|---|---|
| 0289683 | 11/1988 | France . |
| 2364338 | 6/1975 | Germany . |

*Primary Examiner*—Willis Little
*Attorney, Agent, or Firm*—Felfe & Lynch

[57] ABSTRACT

The invention herein provides an apparatus and method for effectively removing the cork and its stoppering elements from a bottle containing a pressurized beverage such as champagne and/or sparkling wine. The apparatus has a support structure configured to be grasped by the operator. The support structure supports at least three blades made of a metal material which extend obliquely upwardly and convergingly inwardly into a space in the apparatus. Due to the relative positioning of the blades, the apparatus screwingly crimps the structure of the stoppering elements in the apparatus when it is applied and rotated. The cork and stoppering elements can then be pulled from the bottle in a controlled fashion.

25 Claims, 2 Drawing Sheets

APPARATUS FOR REMOVING CORK AND STOPPERING STRUCTURE FROM PRESSURIZED BOTTLE

FIELD OF THE INVENTION

This invention relates to methods for removing the cork and stoppering structure from a bottle, especially a champagne bottle, and apparatus therefor.

DESCRIPTION OF THE PRIOR ART

As is well known, a champagne bottle, or other corked bottle containing a carbonated beverage under pressure, is commonly sealed by a stoppering structure which normally comprises a cork in the bottle neck, a tin cap on the cork, a wire cage secured over the cork and the tin cap, and a foil covering applied over the cork, cap, and wire cage.

The need for a simple and safe method for removing the stoppering structure from a bottle of champagne or a similar corked carbonated beverage bottle has been well documented in previous U.S. and foreign patent applications. The difficulties and potential dangers associated with opening such bottles have also been frequently discussed. The problem is of sufficient concern that the United States Food and Drug Administration has considered the mandatory placement of a warning label on all corked carbonated beverage bottles sold in the United States.

A number of devices have been proposed for removing the cork from a champagne bottle. However, none of these devices have proven to be readily manufacturable or especially effective, and do not encompass all of the stoppering elements, i.e., the foil, wire cage, and cap. Also, the grip of prior art designs on the cork of the champagne bottle has been inadequate in that the various designs do not allow a user to develop a secure grip on the all stoppering elements. This reduces the control of the user and lessens the efficiency of the operation of opening the bottle.

SUMMARY OF THE INVENTION

The invention herein provides an apparatus for effectively removing the stoppering elements from a bottle containing a pressurized beverage. The apparatus has a support structure configured to be grasped by the operator. The support structure supports at least three blades made of a metal material which extend obliquely upwardly and convergingly inwardly into a space in the apparatus. Due to the relative positioning of the blades, the apparatus screwingly crimps the structure of the stoppering elements into the apparatus when it is applied and rotated.

This structure provides for a readily manufactured product which firmly grips the cork of a bottle before, during, and after removal. Furthermore, the angling of the blades allows the user to apply a force to the stoppering structure to draw the stoppering structure axially out of the bottle.

Other benefits and objects of the invention will become apparent herein, and the scope of the invention will be articulated in the claims.

DETAILED DESCRIPTION OF THE INVENTION

Figure 5:
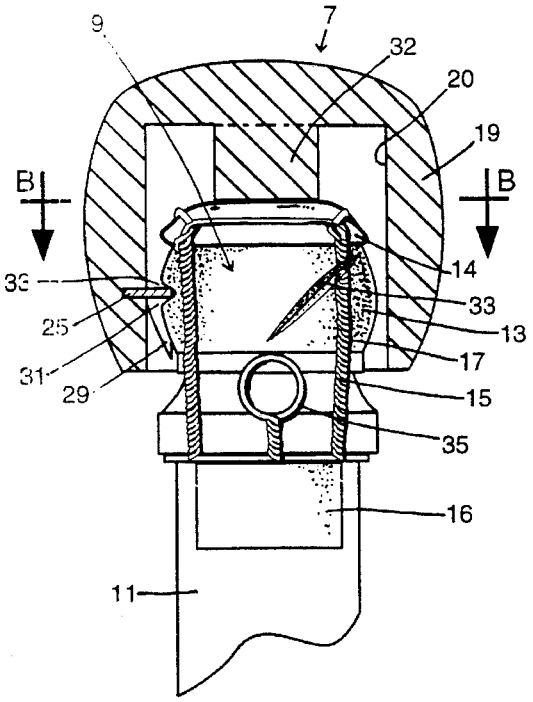
FIG. 5 shows a cut away view the apparatus of FIG. 1 applied to a champagne bottle.
Figure 6:
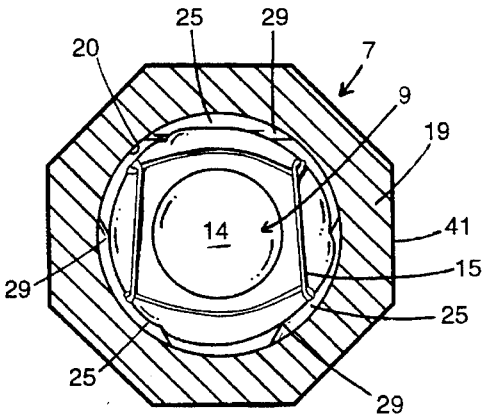
FIG. 6 shows a sectional view taken along line BB of FIG. 5.

As best shown in FIG. 5, the apparatus 7 of the invention is applied to remove stoppering elements generally indicated at 9 from the neck 11 of a bottle.

The stoppering elements of a bottle of a carbonated beverage such as champagne normally comprise a cork 13 of organic or plastic material, a tin cap 14, and a securing structure or cage 15 of wire or some other material which secures the cork 13 in the neck 11 of the bottle despite pressure therein. The cork 13 has a portion 16 which extends into the neck 11 of the bottle, and a bulbous exterior portion 17 outside the neck 11. The stoppering structure also usually includes a foil wrapping (not shown) covering the cork 13, cap 14, and securing structure 15.

Figure 4:
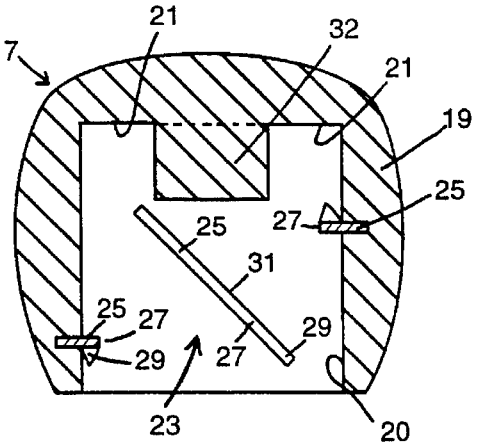
FIG. 4 shows a sectional view taken along line AA of FIG. 1.

Referring to FIG. 4, the apparatus 7 consists of a housing 19 which has therein a substantially cylindrical inner wall 20 and an end wall 21 which together define a generally cylindrical recess or cavity, generally indicated at 23.

Figure 1:
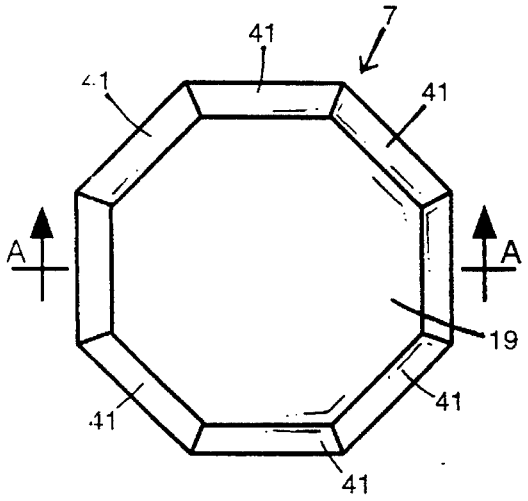
FIG. 1 shows a top view of the cork stoppering removing apparatus of the invention.
Figure 2:
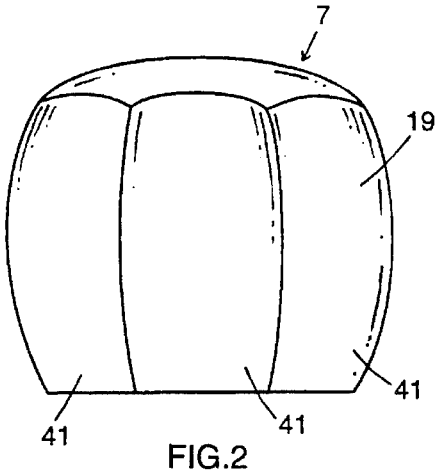
FIG. 2 shows a side view of the apparatus of FIG. 1.
Figure 3:
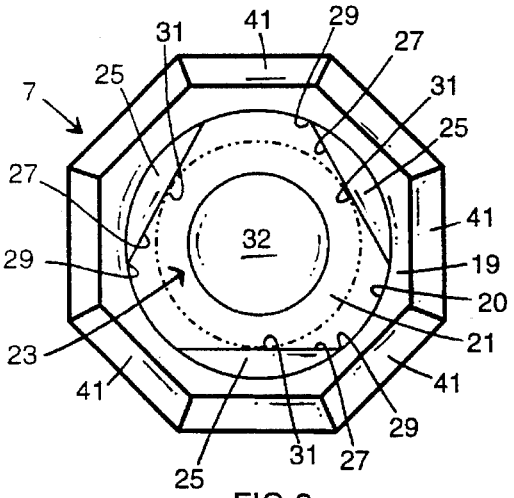
FIG. 3 shows a bottom view of the apparatus of FIG. 1.

Referring to FIG. 3, in the preferred embodiment, the cylindrical inner wall 20 of the housing 7 serves as a support structure which supports three blades 25, which are embedded in the wall 20. The blades 25 extend obliquely into the recess 23 along the wall at an angle in the range of approximately 30 to about 55 degrees, and most preferably at an angle of about 45 degrees relative to the axis of the cylindrical recess 23. These blades 25 are uniformly staggered about the axis of the cylindrical wall 20 at a relative angular displacement of about 120 degrees with respect to each other. In the preferred embodiment, the blades 25 are formed of 3 mm thick stainless steel of the 400 series, of hardened spring steel, or of other metal of appropriate hardness to make a firm crimping engagement with the stoppering structure of the bottle and to withstand repeated operative contact with the stoppering elements. Materials having a Rockwell hardness of about 50 or greater are particularly preferred.

To use the device, an operator grasps the apparatus 7 and applies it to the stoppering structure 9 of the bottle to be opened. The foil covering of the structure may be either left on the stoppering structure 9 or removed to uncover the wire cage and other components.

The blades 25 have straight edge portions 27 with lower ends 29. The lower ends 29 of the blades 25 lie in a circle whose radius is substantially the same as that of the cylindrical wall 20, about 0.7 inches. As best seen in FIGS. 3 and 4, the blade edge portions 27 extend obliquely upwardly from the ends 29 at an angle of about 30 to 55 degrees, and preferably 45 degrees, relative to the plane of the circle of the lower ends 29.

The direction of upward extension of the edge portions 27 is also angled in a direction which is radially inward of the circle of the lower ends 29. The radially inward angle of the edge portion 27 causes the edge portion 29 to extend convergingly upward, and results in a tapering of the space defined between the blades 25. The space tapers inward until the midportions 31 of edge portions 27. At the midportions 31, the blades 25 define a point of narrowest convergence in the space which can be circumscribed by the circle shown in phantom in FIG. 3. This circle has a radius of about ½ to 19/32 inches and preferably 0.54 inches, which is a desirable dimension for use with the usual cork sizes in the industry.

As the apparatus 7 is applied to the stoppering structure of the bottle, the stoppering structure initially passes between the lower ends 29 of the blades 25, and contacts the edge portions 27 inward of the recess 23 as the space between them tapers radially inward. The user then applies downward pressure and rotation to the apparatus 7, which causes the blades 25 to cut indentations 33 in the stoppering structure 9, as best shown in FIG. 5. The slope of edge portions 27 causes the blades 25 to cammingly slide in the indentations 33 and draw the stoppering structure 9 into the recess 23 as the apparatus 7 is rotated. Because the space between the edge portions 27 tapers inwardly, as the stoppering structure 9 is drawn in, it is progressively wedged or crimpingly screwed in tight engagement between blades 25.

The material of the blades 25 is such that the crimping engagement is secure whether or not the foil covering or the wire cage are left on the bottle.

Once the stoppering structure 9 has been so secured in the apparatus, the wire securement structure is loosened, as by turning loop 35. The operator then rotates and/or pulls the stoppering structure 9 with the apparatus and draws the cork out of the bottle. The angle of the blades 25 relative to the stoppering structure allows the operator to apply an axial force, i.e., a force in line with and directly away from the bottle neck, to the stoppering structure to draw the structure to draw the structure out of the bottle.

Owing to the mass of the apparatus 7 and the secure hold that it provides to the operator, there is no likelihood of a rapid ejection of the apparatus and stoppering structure. The operator is free to remove the stoppering structure 9 at whatever speed is desired, whether quickly, to produce a popping sound, or slowly, to release pressure with less noise.

The dimensions of the cylindrical recess 23 and the blades 25 are configured to optimally accommodate the various cork sizes in general use in the industry. The diameter of the recess 23 is about 1.4 inches. The blades 25, at their widest point, project about 0.16 inches into the recess 23 from the cylindrical wall 20.

The vertical depth of recess 23 is about 1½ inches. If the stoppering structure 9 were drawn a full 1½ inches into the recess, it would possibly prove difficult to remove due primarily to the widening of the space between edge portions 27 inward of the narrowest convergence at midportions 31. Accordingly, to prevent the stoppering structure 9 from being drawn too far into the recess 23, end wall 21 includes a cylindrical knob or abutment portion 32 which blocks the entry of the cork 13 beyond a certain point. The depth of the recess 23 to abutment surface is ideally about one inch.

A generally annular space extends around between the knob 32 and the cylindrical wall 20. This interior space reduces the weight of the apparatus, and gives the apparatus a more comfortable balance in the user's hand. Alternatively, the end wall 21 may be lowered to intersect with the blades 25 one inch into the recess. The end wall 21 is then flat and the recess 23 is one inch deep. The blades 25 are retained in the same positions as in the embodiment of FIG. 4.

Figure 7:
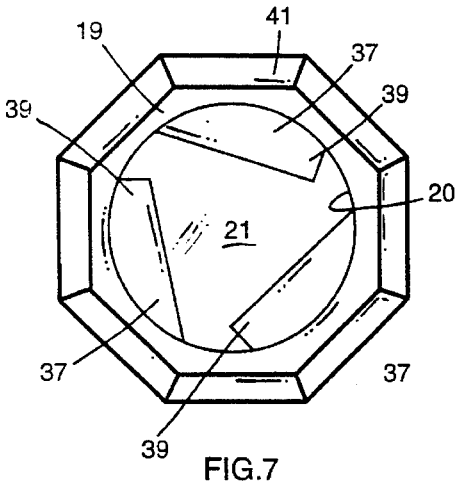
FIG. 7 is a bottom view of an alternate embodiment of the apparatus.
Figure 8:
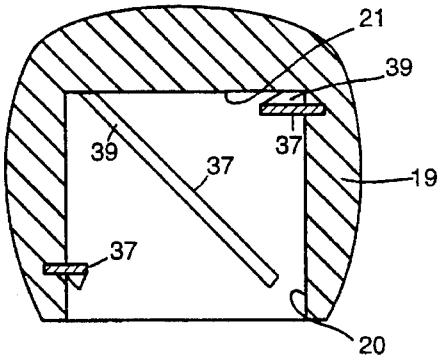
FIG. 8 is a sectional view as in FIG. 4 of the alternate embodiment of FIG. 7.

FIGS. 7 and 8 disclose an alternate embodiment of the cork removal apparatus. Instead of being provided with a knob 32, the taper of blades 37 is such that the upper ends 39 of the blades 37 engage the end wall 21, and are radially close enough together to prevent entry of the stoppering structure to a point where removal may be difficult.

The housing 19 is provided with a plurality of curved flat portions 41 which are angulated about the exterior of the housing 19 to give the user a firm grip of the apparatus 7. The housing 19 in the embodiments shown is formed of a metal material, although it will be understood that other materials, such as wood or plastic, can be used with similar results. The housing can be made by any of a variety of methods known in the art, including insert casting, transfer molding, injection molding, or a lost wax process. In these processes, the blades are held in place while the housing is cast around them, or, alternatively, the blades are cast together with the housing if the housing of appropriate material.

Generally speaking, the housing 19 is of a size adequate to enclose a cavity which can receive the stoppering structure, but nevertheless can fit discreetly in the hand of the operator so as not to be noticed. In the preferred embodiment, the height of the apparatus is about 1 25/32 inches. It will be understood, however, that the shape of the housing may be varied considerably without departing from the invention herein. Specifically, the apparatus may have a recess 23 only about one inch deep, and housing 19 may be consequently made much shorter by making wall 21 very thin. The resulting apparatus would be only about one inch in height, which might be desirable where a particularly compact apparatus is desired.

It will be understood that the terms used herein are terms of description rather than limitation, as those skilled in the art with this specification in hand will be able to vary the details of the invention disclosed herein without departing from the spirit thereof.

What is claimed is:

1. An apparatus for removing a stoppering structure from a bottle wherein the stoppering structure has a portion extending longitudinally outwardly from the bottle, said apparatus comprising:

a support structure adapted to be held in the hand of an operator; and at least three metallic blades supported on the support structure, said blades defining therebetween a stoppering structure receiving space, each blade having an edge portion disposed toward said receiving space, each blade having a lower end portion and being supported so that the lower end portions of said blades are positioned to lie on a circle which is large enough to permit passage of the stoppering structure portion into said receiving space;

each of said blades extending at an angle of approximately 30 degrees to approximately 60 degrees obliquely relative to the plane of said circle radially inwardly of the circle from the end portion thereof at a relative distance from the other blades so that the blades cut into said stoppering structure portion and cammingly draw said stoppering structure portion into said receiving space when said apparatus is applied over said stoppering structure and rotated.

2. The invention according to claim 1 and said edge portions being substantially straight.

3. The invention according to claim 2 and said blades being formed of stainless steel or other metal of similar hardness.

4. The invention according to claim 1, and said blades extending upwardly at an angle of approximately 45 degrees to the plane of said circle.

5. The invention according to claim 2, and said support structure comprising a housing having an inner wall portion defining a recess therein, said blades being supported on said inner wall portion and extending into said recess.

6. The invention according to claim 5, and said housing including an abutment structure in said recess, said abutment structure engaging the stoppering structure portion and preventing the movement thereof into the receiving space substantially beyond the point of closest convergence of said blades.

7. The invention according to claim 6, and said blades at their nearest points of convergence each being about 0.54 inches from the center of said receiving space.

8. The invention according to claim 6, and said inner wall being substantially cylindrical.

9. The invention according to claim 8, and said housing being formed of metal material.

10. The invention according to claim 2, and said blades being approximately 3 millimeters thick.

11. The invention according to claim 1, and said end portions of said blades being positioned about said circle at generally equidistant staggered intervals.

12. The invention according to claim 1, and said three blades extending being staggered at 120 degrees to each other about said circle.

13. An apparatus for removing a stoppering structure from a bottle wherein the stoppering structure has an exterior portion extending outwardly from the neck of the bottle, said apparatus comprising:

a housing portion configured to be grasped by the operator;

said housing portion having an internal wall portion therein defining a recess of a size capable of accommodating therein said exterior portion of said stoppering structure;

said wall portion supporting a plurality of blades in said recess, said blades extending generally obliquely into said recess along said wall portion at an angle of about 45 degrees, said blades having substantially straight edge portions extending convergingly toward each other inwardly of said recess so that said blades crimpingly screw said stoppering structure into said apparatus when the apparatus is applied to said stoppering structure and rotated.

14. The invention according to claim 13 and said blades being of metallic material.

15. The invention according to claim 14, and said wall portion defining said recess to be generally cylindrical in shape.

16. The invention according to claim 15, and said housing portion having a top portion including an end wall portion defining an end to said recess.

17. The invention according to claim 16, and said end wall having a raised abutment portion therein engageable with said stoppering structure to prevent entry of said stoppering structure exterior portion beyond a certain point in said recess.

18. The invention according to claim 17, and said housing portion having an external gripping surface portion.

19. The invention according to claim 18, and said gripping surface portion comprising a plurality of relatively angulated flats for enhancing grip of an operator on said housing portion.

20. An apparatus for removing a stoppering structure from a bottle, said stoppering structure having a stopper portion extending outside the neck of said bottle, said apparatus comprising:

a housing portion having an exterior gripping surface defined by a plurality of flat portions angulated relative to each other about an axis of the housing portion;

said housing portion having a generally cylindrical inner wall and an end wall adjacent said inner wall defining therewith a general cylindrical cavity in said housing portion of a size to receive therein said stopper portion; and three engagement blades of metallic material supported on said inner wall and each extending obliquely inward of said cavity at a angle of about 30 to about 60 degrees relative to the axis and having an edge portion lying in a plane generally tangent to a cylinder of smaller radius then said cylindrical inner wall about substantially the same axis as the cylindrical inner wall, said blades being rotatively staggered about said axis at angles of about 120 degrees relative to each other.

21. The invention according to claim 20, and said blades extending axially inward of the cavity at an angle of approximately 45 degrees to the axis thereof.

22. The invention according to claim 21, and said cylinder defined by said tangency of said blades having a radius of about 0.5 to about 0.6 inches.

23. The invention according to claim 21, and said cylinder defined by said tangency of said blades having a radius of about 0.54 inches.

24. A method for removing a stoppering structure from a bottle extending in an axial direction, said stoppering structure including a cork having a first portion extending with said neck of the bottle, a second portion extending axially beyond said neck, a securement structure surrounding said cork and engaging said bottle neck to secure the cork therein, and a covering structure over said cork and securement structure, said method comprising applying a removing apparatus to said stoppering structure, said apparatus having at least three blades supported thereon, said blades having edge portions, said edge portions having axially terminal ends spaced to receive a portion of said stoppering structure therein, each of said edge portions extending axially away from its respective end portion at an angle of approximately 45 degrees to said axial direction and convergingly toward the edge portions of the other blades, pressing and rotating said apparatus and said stoppering structure in such a way as to cause said blades to screwingly clamp onto said stoppering structure, and drawing said stoppering structure axially away from said neck of the bottle.

25. The method of claim 24 and further comprising the step of loosening the securement structure before the drawing of the stoppering structure from the bottle.

* * * * *